US008096275B2

(12) United States Patent
Marriott et al.

(10) Patent No.: US 8,096,275 B2
(45) Date of Patent: Jan. 17, 2012

(54) CAMSHAFT HAVING A TUNED MASS DAMPER

(75) Inventors: Craig D. Marriott, Clawson, MI (US); Hong Wai Nguyen, Troy, MI (US); Ronald Jay Pierik, Holly, MI (US)

(73) Assignee: GM Global Technology Operations LLC

( * ) Notice: Subject to any disclaimer, the term of this patent is extended or adjusted under 35 U.S.C. 154(b) by 323 days.

(21) Appl. No.: 12/559,948

(22) Filed: Sep. 15, 2009

(65) Prior Publication Data

US 2011/0061614 A1 Mar. 17, 2011

(51) Int. Cl.
*F01L 1/04* (2006.01)

(52) U.S. Cl. ..... 123/90.6; 123/90.31; 123/90.44; 29/888.1

(58) Field of Classification Search ..... 123/90.16, 123/90.27, 90.31, 90.44, 90.6; 29/888.1
See application file for complete search history.

(56) References Cited

U.S. PATENT DOCUMENTS 6,425,357 B2 * 7/2002 Shimizu et al. ..... 123/90.16
2009/0084333 A1 4/2009 Cleary et al.

* cited by examiner

*Primary Examiner* — Ching Chang
(74) *Attorney, Agent, or Firm* — Harness, Dickey & Pierce, P.L.C.

(57) ABSTRACT

A camshaft assembly may include a first shaft adapted to be rotationally driven, a first lobe member fixed for rotation with the first shaft, and a torsional damper fixed to the first shaft. The torsional damper may include a mass structure fixed to the first shaft and an elastic member disposed between and coupling the mass structure and the first shaft. The elastic member may have a spring constant providing a first sideband natural frequency and a second sideband natural frequency for the camshaft assembly.

20 Claims, 7 Drawing Sheets

FIG 6
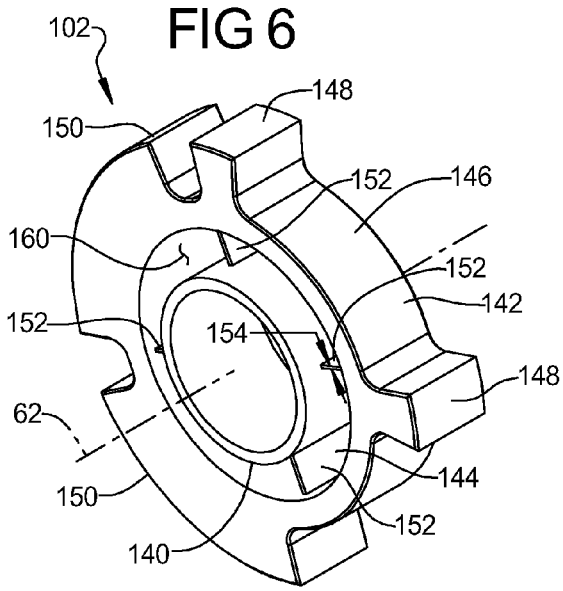
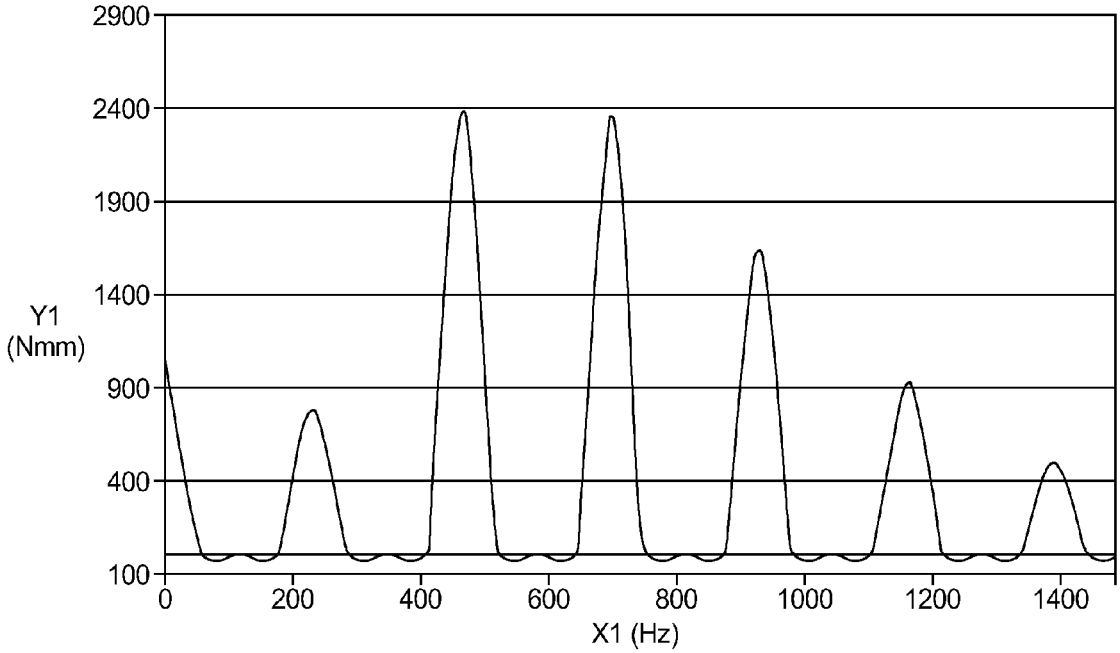
FIG 7

CAMSHAFT HAVING A TUNED MASS DAMPER

FIELD

The present disclosure relates to engine camshaft assemblies and, more particularly, to concentric camshaft assemblies.

BACKGROUND

This section provides background information related to the present disclosure which is not necessarily prior art.

Internal combustion engines may combust a mixture of air and fuel in cylinders and thereby produce drive torque. Air and fuel flow into and out of the cylinders may be controlled by a valvetrain. Valvetrains typically include a camshaft that actuates intake and exhaust valves and thereby controls the timing and amount of air and fuel entering the cylinders and exhaust gases leaving the cylinders. In overhead camshaft (OHC) valvetrains, the camshaft is located in a cylinder head above the combustion chambers and typically actuates the intake and exhaust valves via lifters coupled to the intake and exhaust valves.

Engines having multiple intake and/or exhaust valves in each cylinder may include a dual OHC valvetrain configuration. Dual OHC valvetrains typically include a first camshaft that actuates the intake valves and a second camshaft that actuates the exhaust valves. Typically, the camshafts include a lobe corresponding to each of the respective intake and exhaust valves that controls the valve timing. Some camshafts are concentric camshafts that provide for relative rotation between first lobe members and second lobe members that actuate the valves. The first lobe members may be fixed to a tubular outer shaft for rotation with the outer shaft. The second lobe members may be radially supported by the outer shaft and may be fixed for rotation with an inner shaft. The inner shaft may be disposed within the outer shaft and may be radially supported by the outer shaft.

A cam phaser may be coupled to the outer shaft and the inner shaft and may control a relative rotational position between the outer shaft and the inner shaft. In this manner, the cam phaser may be used to adjust the overall timing of the valves by varying the duration of valve opening. A timing wheel may be coupled to one of the outer shaft and the inner shaft and may be used to sense a rotational position of the corresponding shaft.

SUMMARY

A camshaft assembly may include a first shaft adapted to be rotationally driven, a first lobe member fixed for rotation with the first shaft, and a torsional damper. The torsional damper may include a mass structure and an elastic member disposed between and coupling the mass structure and the first shaft. The elastic member may have a spring constant providing a first sideband natural frequency and a second sideband natural frequency for the camshaft assembly.

In an alternate arrangement, a camshaft assembly may include a first shaft assembly and a second shaft assembly. The first shaft assembly may include a first shaft and first lobe member fixed to the first shaft. The first shaft may be adapted to be rotationally driven and may have an axially extending bore. A second shaft assembly may include a second shaft, a second lobe member, and a torsional damper. The second shaft may be disposed within the axially extending bore and may be rotatable relative to the first shaft. The second shaft may additionally include a first end adapted to be rotationally driven and a second end opposite the first end. The second lobe member may be rotationally supported on the first shaft and fixed for rotation with the second shaft. The torsional damper may be fixed to the second shaft.

In an alternate arrangement, a camshaft assembly may include a first shaft assembly and a second shaft assembly. The first shaft assembly may include a first shaft and a first lobe member fixed to the first shaft. The first shaft may be adapted to be rotationally driven and may define an axially extending bore. The second shaft assembly may include a second shaft, a second lobe member, and a torsional damper fixed to the second shaft. The second shaft may be disposed within the axially extending bore and may be rotatable relative to the first shaft. The second shaft may include a first end adapted to be rotationally driven and a second end opposite the first end. The second lobe member may be rotationally supported on the first shaft and fixed for rotation with the second shaft. The torsional damper may include an annular ring and an elastic member disposed between and coupling the annular ring to the second shaft. The elastic member may be adapted to provide a first rotational oscillation of the annular ring that is out of phase with a corresponding second rotational oscillation of the second shaft during rotation of the second shaft.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

FIG. 6 is a perspective view of the timing wheel of FIG. 1;

FIG. 7 is a chart illustrating a torque input for the camshaft assembly of FIG. 1.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
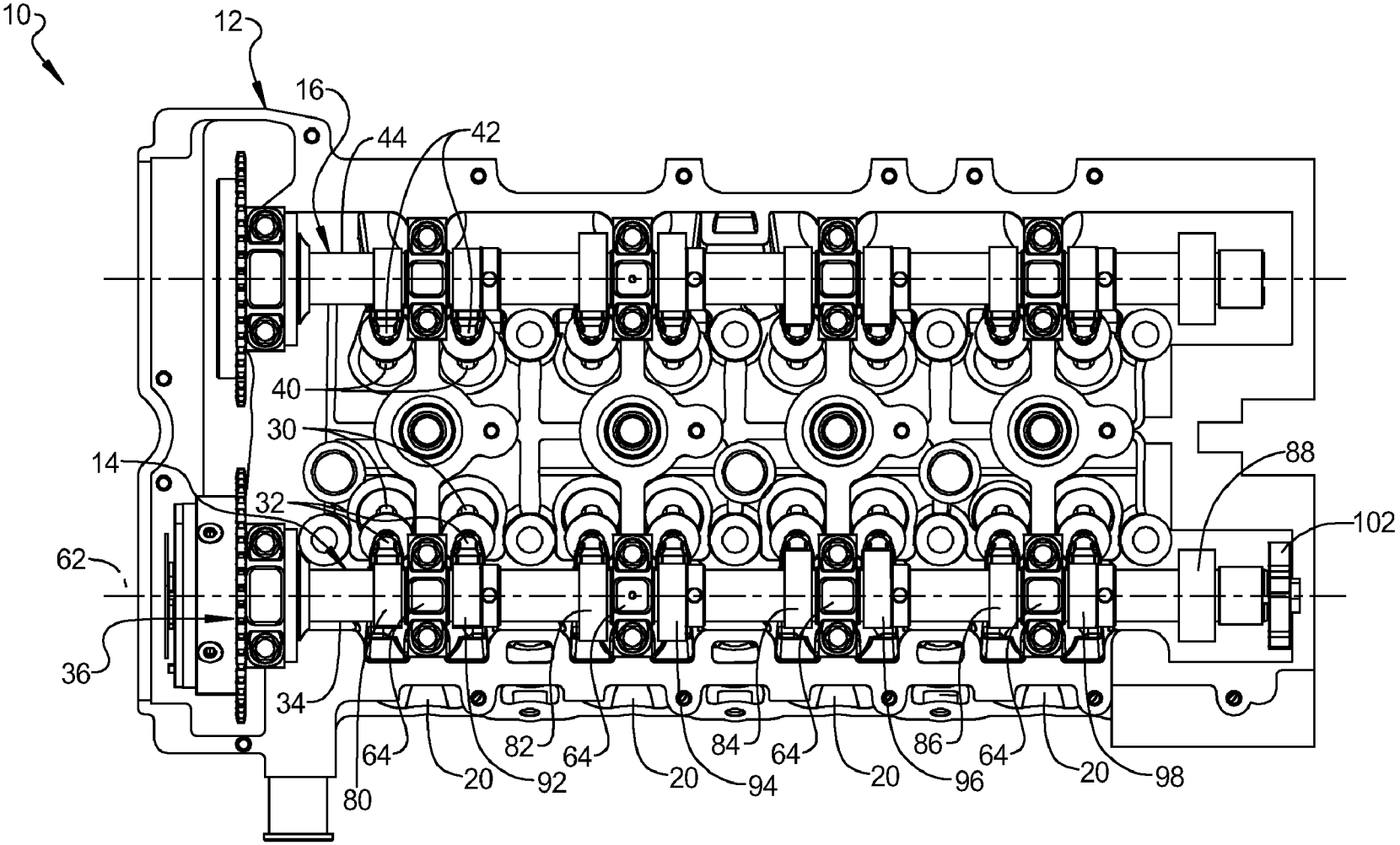
FIG. 1 is a plan view of a portion of a cylinder head assembly according to the present disclosure.
Figure 2:
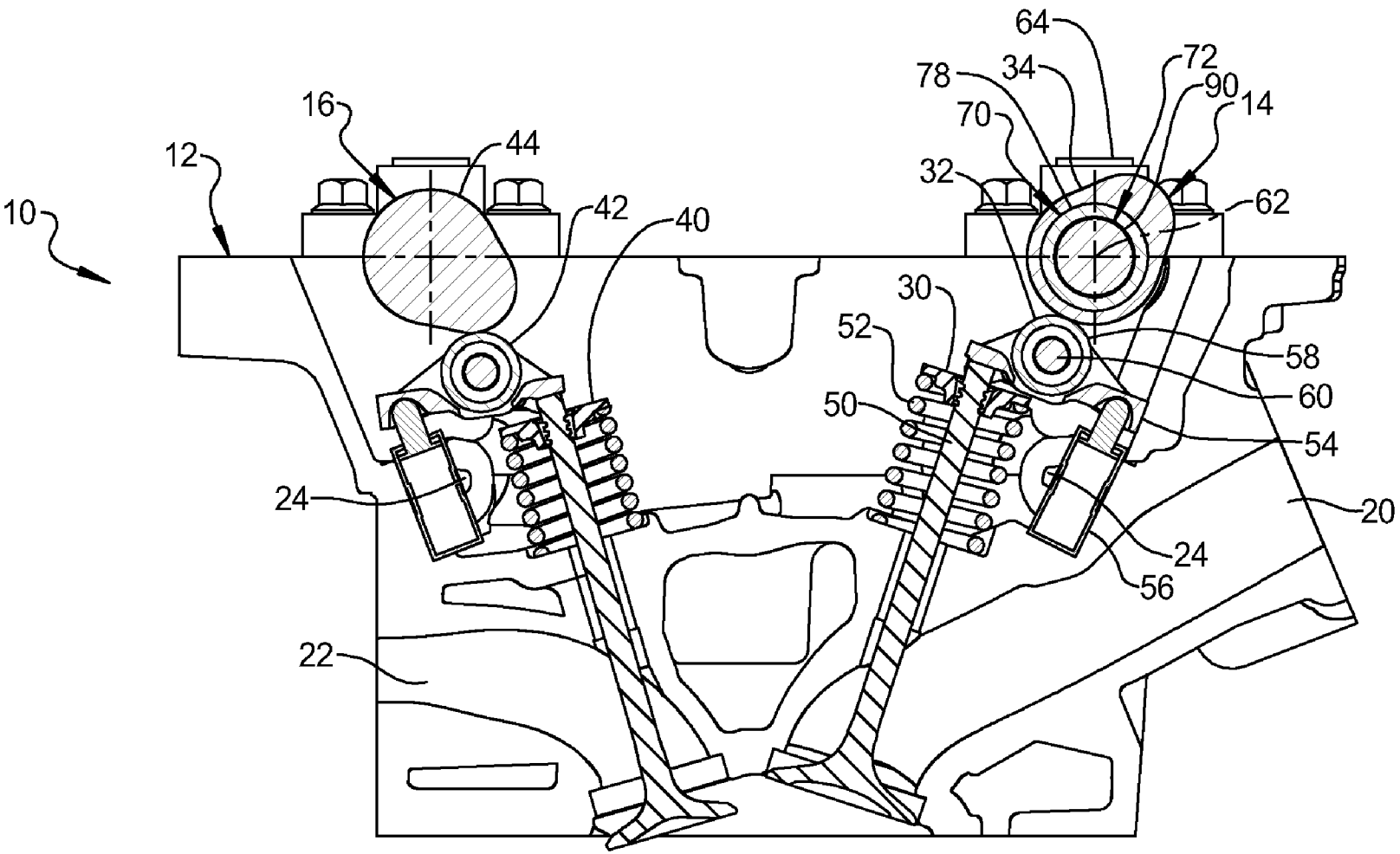
FIG. 2 is a section view of the cylinder head assembly of FIG. 1.

With reference to FIGS. 1-2, a cylinder head assembly 10 for an engine assembly is illustrated. The cylinder head assembly 10 shown is of the overhead camshaft type and may be mounted to an engine block structure (not shown). However, the present disclosure is not limited to overhead camshaft arrangements. The engine block structure may be one of several configurations including, but not limited to, in-line type and V-type configurations.

The cylinder head assembly 10 may include a cylinder head structure 12, an intake valvetrain assembly 14, and an exhaust valvetrain assembly 16. The cylinder head structure 12 supports the intake and exhaust valvetrain assemblies 14, 16 and may include intake ports 20, exhaust ports 22, and fluid passages 24. The intake and exhaust ports 20, 22 may direct intake air entering the cylinders and combustion gases exiting the cylinders. The fluid passages 24 may direct pressurized fluid from within the engine to various components of the intake and exhaust valvetrain assemblies 14, 16.

The intake valvetrain assembly 14 may include intake valve assemblies 30 actuated via intake valve lift mechanisms 32 by an intake camshaft assembly 34. The intake valvetrain assembly 14 may further include a cam phaser 36. The exhaust valvetrain assembly 16 may include exhaust valve assemblies 40 actuated via exhaust valve lift mechanisms 42 by an exhaust camshaft assembly 44.

The exhaust valve assemblies 40 and the exhaust valve lift mechanisms 42 may be generally similar to the intake valve assemblies 30 and the intake valve lift mechanisms 32, respectively. Therefore, for simplicity, the intake valve assemblies 30 and the intake valve lift mechanisms 32 are described in detail below with the understanding that the description applies equally to the exhaust valve assemblies 40 and the exhaust valve lift mechanisms 42.

The exhaust camshaft assembly 44 may be of a conventional single camshaft type as shown. Accordingly, for brevity, the exhaust camshaft assembly 44 will not be described in detail. Alternatively, the exhaust camshaft assembly 44 may be generally similar to the intake camshaft assembly 34. While the exhaust camshaft assembly 44 is not described in detail, it should be understood that the description of the intake camshaft assembly 34 provided below may equally apply to the exhaust camshaft assembly 44.

With particular reference to FIG. 2, the intake valve assemblies 30 may include intake valves 50 disposed in the intake ports 20, and spring elements 52. The intake valves 50 may be biased in a closed position by the spring elements 52.

The intake valve lift mechanisms 32 may include rocker arms 54 and lash adjusters 56. The rocker arms 54 may engage corresponding intake valves 50 on one end and corresponding lash adjusters 56 on an opposite end. The rocker arms 54 may pivot about corresponding lash adjusters 56 and may include roller elements 58 that pivot about shafts 60 and that engage corresponding lobe members 80, 82, 84, 86, 92, 94, 96, 98. The lash adjusters 56 may be hydraulically-actuated and may provide hydraulic lash adjustment that maintains engagement between the rocker arms 54, the lobe members 80, 82, 84, 86, 92, 94, 96, 98, and the intake valves 50. Pressurized fluid may be provided to the lash adjusters 56 via the fluid passages 24.

While FIGS. 1-2 illustrate the intake valve lift mechanisms 32 are of the rocker-type, it is understood that the present disclosure is not limited solely to rocker-type configurations and applies equally to other conventional valve lift mechanisms. As one non-limiting example, the present disclosure applies to valve lift mechanisms that include lifters disposed between and directly engaged with the intake valves and the camshaft.

The intake camshaft assembly 34 may be disposed above the intake valves 50 and the rocker arms 54 and may be fixed for rotation within the cylinder head structure 12 about a rotational axis 62. The intake camshaft assembly 34 may be supported by bearing caps 64 that may be axially spaced along the length of the intake camshaft assembly 34.

Figure 3:
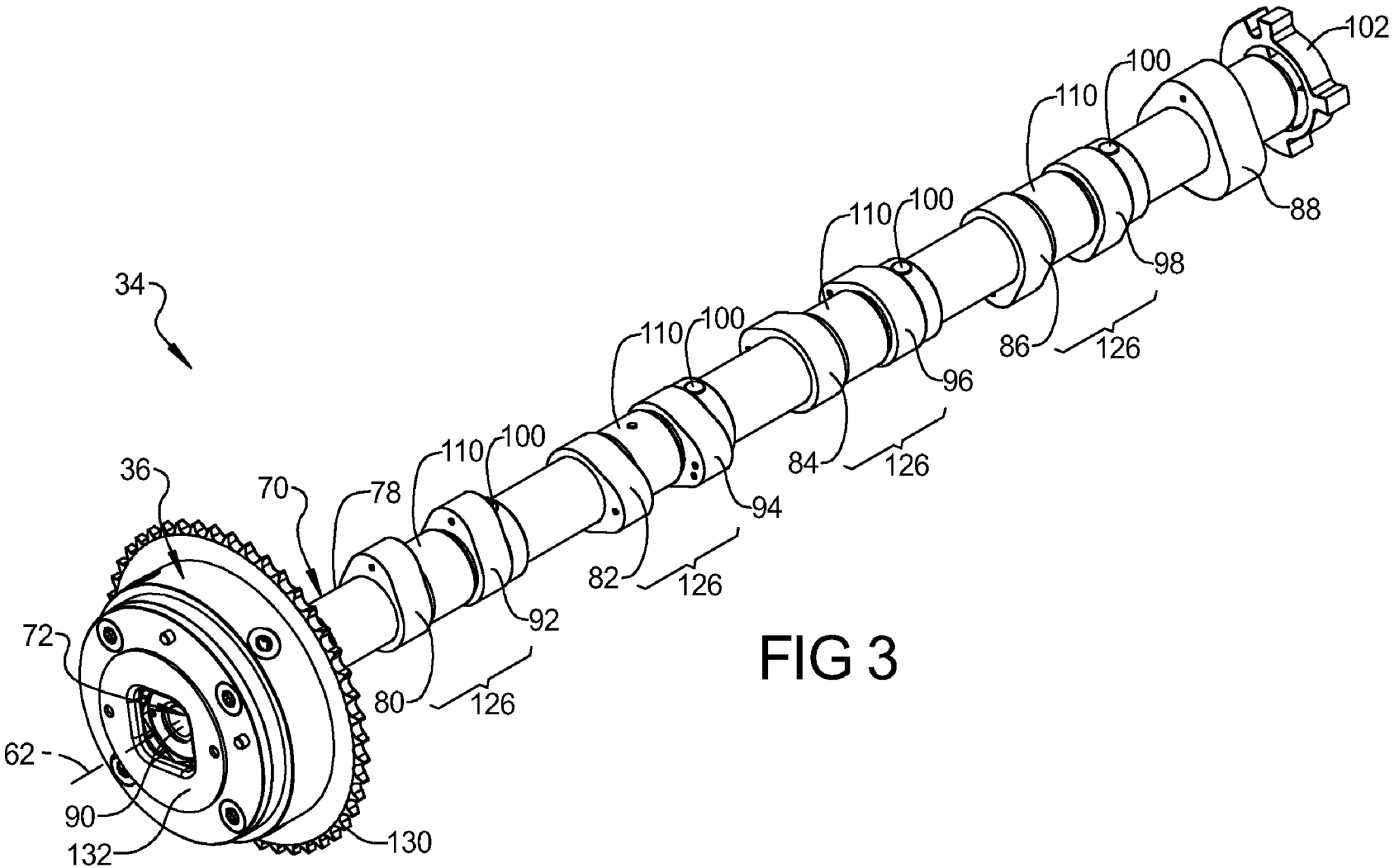
FIG. 3 is a perspective view of the camshaft assembly and cam phaser of FIG. 1.
Figure 4:
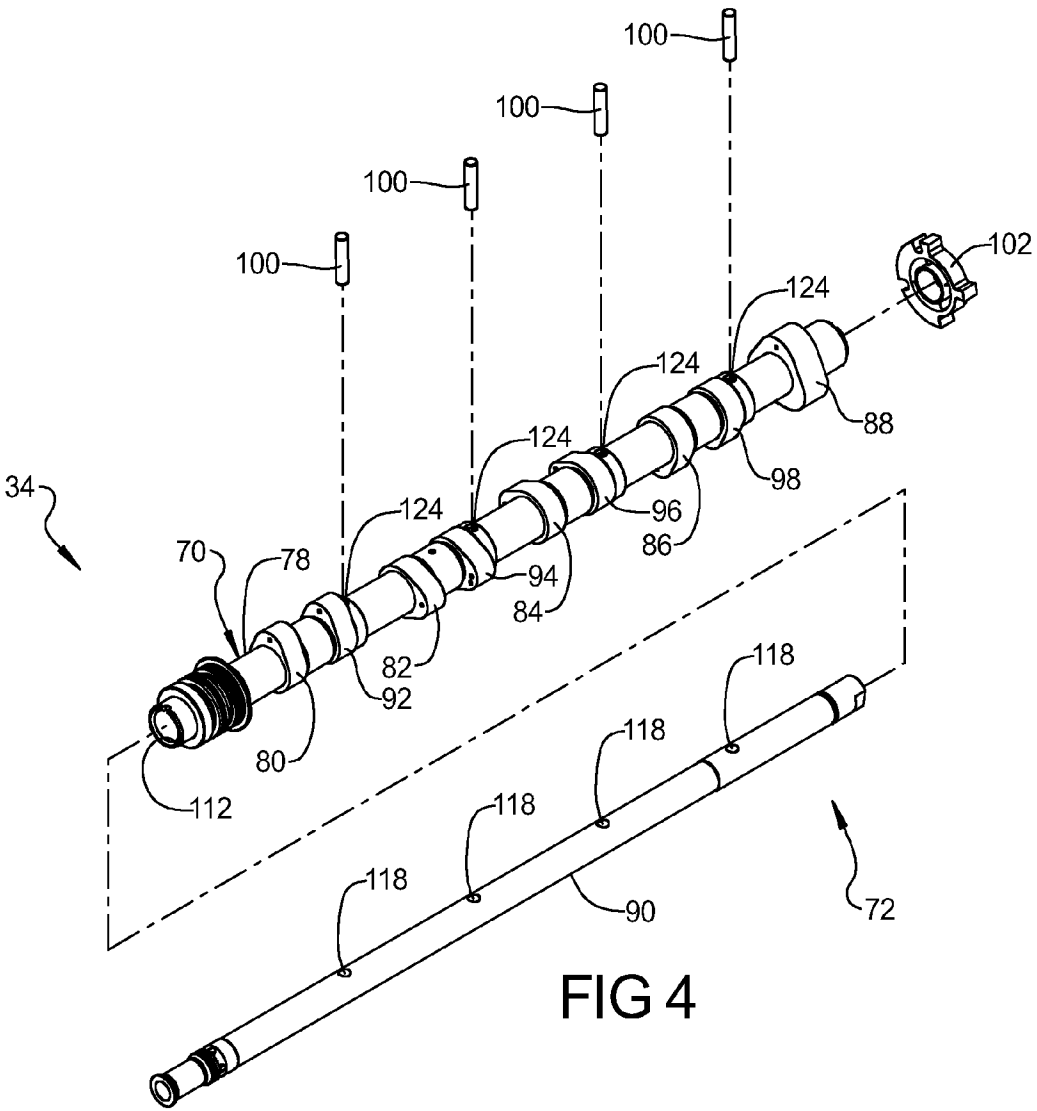
FIG. 4 is a perspective exploded view of the camshaft assembly of FIG. 1.
Figure 5:
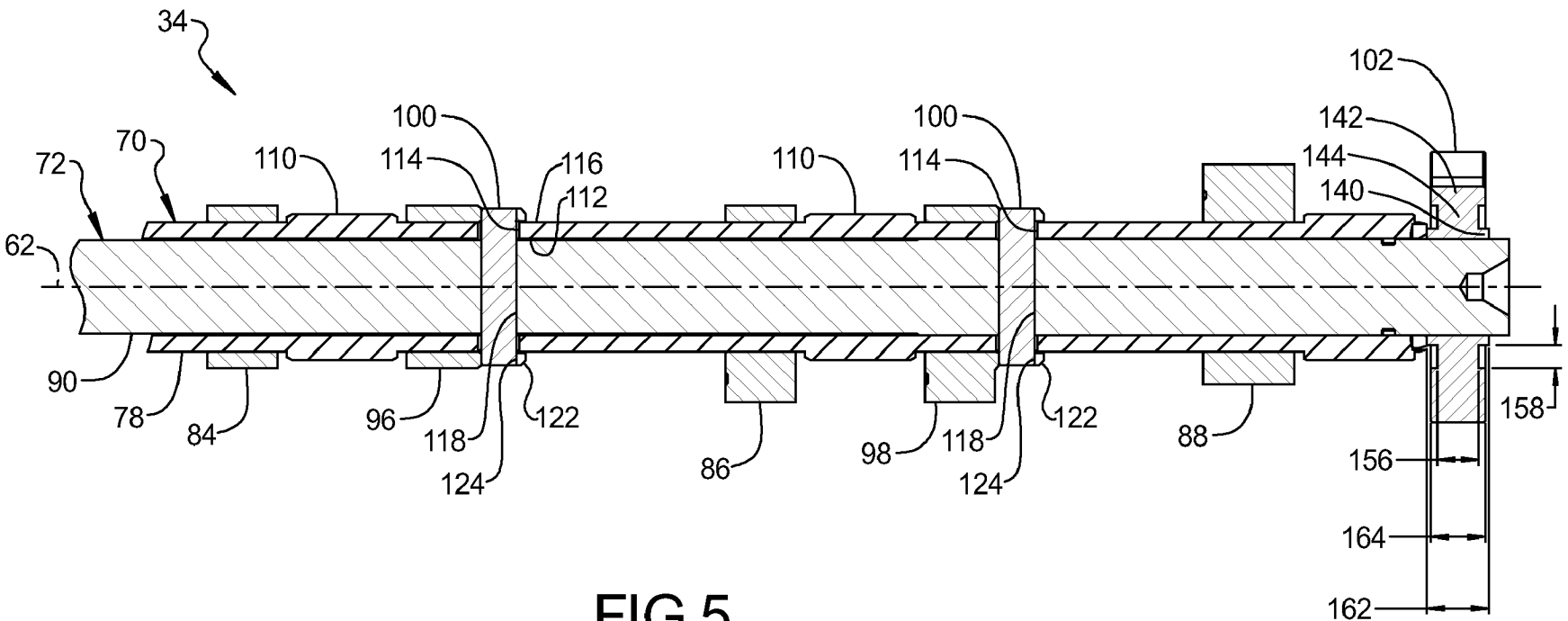
FIG. 5 is a fragmentary section view of the camshaft assembly of FIG. 1.

With additional reference to FIGS. 3-5, the intake camshaft assembly 34 may include a first shaft assembly 70 and a second shaft assembly 72. The first shaft assembly 70 may include a first shaft 78 and a first set of lobe members 80, 82, 84, 86, 88. The second shaft assembly 72 may include a second shaft 90, a second set of lobe members 92, 94, 96, 98, drive pins 100, and a timing wheel 102.

The first shaft 78 may be fixed for rotation with the cam phaser 36 and may include journals 110, an axial bore 112, and circumferential slots 114. The journals 110 may be machined in an outer surface 116 and may engage the cylinder head structure 12, including corresponding bearing caps 64. The journals 110 may be located between adjacent lobe members 80, 82, 84, 86, 92, 94, 96, 98. Alternatively or additionally, the journals 110 may be located between adjacent pairs of lobe members 80, 82, 84, 86, 92, 94, 96, 98. The axial bore 112 may extend through the center of the first shaft 78 and may receive the second shaft 90. The circumferential slots 114 may extend crosswise through the first shaft 78 and may receive corresponding drive pins 100. The circumferential slots 114 may allow for rotational travel of the drive pins 100. The circumferential slots 114 may also limit axial movement of the drive pins 100.

The first set of lobe members 80, 82, 84, 86, 88 may be received on and fixed for rotation with the first shaft 78. As a non-limiting example, the first set of lobe members 80, 82, 84, 86, 88 may be frictionally engaged with the first shaft 78.

The second shaft 90 may be co-axially disposed within and radially supported by the axial bore 112. The second shaft 90 may be fixed for rotation with the cam phaser 36 and may be rotatable relative to the first shaft 78. The second shaft 90 may include radial bores 118 that receive corresponding drive pins 100 and thereby couple the second set of lobe members 92, 94, 96, 98 for rotation with the second shaft 90.

The second set of lobe members 92, 94, 96, 98 may be received on and radially supported by the first shaft 78. The second set of lobe members 92, 94, 96, 98 may include shoulder portions 122 including lateral apertures 124 adjacent the circumferential slots 114. The lateral apertures 124 may receive corresponding drive pins 100 and thereby couple the second set of lobe members 92, 94, 96, 98 for rotation with the second shaft 90.

Lobe members 80, 82, 84, 86 and lobe members 92, 94, 96, 98 may engage corresponding rocker arms 54 and thereby actuate corresponding intake valves 50. Each of the lobe members 80, 82, 84, 86 may be disposed adjacent a corresponding one of the lobe members 92, 94, 96, 98 and thereby form lobe pairs 126. Each of the lobe pairs 126 may correspond to one of the cylinders of the engine. Lobe member 88 may be engaged with and actuate a fuel pump (not shown).

The cam phaser 36 may be driven by a crankshaft (not shown) and may include a first phaser member 130 and a second phaser member 132. The first phaser member 130 may be driven by the crankshaft and may be coupled to the first shaft 78. The second phaser member 132 may be coupled to the second shaft 90. The first and second phaser members 130, 132 may provide axial alignment between the first and second shafts 78, 90, respectively, and may thereby inhibit axial displacement between the first and second shafts 78, 90. The first and second phaser members 130, 132 may be rotatable relative to one another. The cam phaser 36 may be actuated to rotate the first and second shafts 78, 90 relative to one another and thereby vary valve timing and effective valve duration.

The timing wheel 102 may be fixed for rotation with the second shaft 90 and may be disposed on an end of the second shaft 90 opposite the cam phaser 36. The timing wheel 102 may be used to sense the rotational position of the second shaft 90. The timing wheel 102 may be used to sense the rotational position of the second shaft 90 relative to a rotational position of another component of the engine used for reference, such as the crankshaft. In the foregoing manner, the timing wheel 102 may also be used to sense the rotational position of the lobe members 92, 94, 96, 98 relative to the reference rotational position. As discussed below, the timing wheel 102 may form a torsional damper, and more specifically a tuned mass damper, that controls the torsional response of the second shaft assembly 72 to a torque input of the intake valvetrain assembly 14. While discussed in the present non-limiting example as being part of the timing wheel 102, it is understood that the present disclosure applies equally to arrangements where the rotational damper is provided without any timing function.

The timing wheel 102 may dampen the torsional response where the second shaft assembly 72 has a natural frequency that occurs within a predetermined frequency range where the energy content of the torque input is high and may otherwise exhibit resonant-type behavior. Undamped, the second shaft assembly 72 may exhibit a torsional response resulting in variation in seating velocity, valve timing, and/or cylinder-to-cylinder air distribution. The undamped response may also cause mechanical fatigue.

The timing wheel 102 may control the torsional response by functioning as a tuned mass damper for the second shaft assembly 72. The timing wheel 102 may divide the natural frequency of the second shaft assembly 72 into bimodal sideband natural frequencies such that lower amplitudes are achieved in the torsional response. One of the sideband natural frequencies may occur within the predetermined frequency range, while another of the sideband natural frequencies may occur above the predetermined frequency range.

With additional reference to FIG. 6, the timing wheel 102 may include a hub 140 coupled to a timing ring 142 by an elastic member 144. The hub 140, the timing ring 142, and the elastic member 144 may be integrally formed as a monolithic member and may be formed from the same base material. The hub 140 may generally have a tubular shape and may be fixed to the second shaft 90.

The timing ring 142 may include an annular ring 146, a first set of teeth 148, and a second set of teeth 150. The annular ring 146 may be disposed radially outward of the hub 140. The annular ring 146 may be concentric with the hub 140. The first and second sets of teeth 148, 150 may protrude radially outward from the annular ring 146 at predetermined rotational positions around the periphery of the annular ring 146. The first and second sets of teeth 148, 150 may be integrally formed with the annular ring 146. The circumferential width of the first set of teeth 148 may be different than the circumferential width of the second set of teeth 150 and may be smaller than the circumferential width of the second teeth 150. The rotational position of the second shaft 90 may be sensed by a sensor (not shown) that detects the presence and thereby rotation of the first and second sets of teeth 148, 150.

The elastic member 144 may be disposed between the hub 140 and the annular ring 146. The elastic member 144 may be configured such that a first rotational mass of the timing ring 142 is compliantly isolated from a second rotational mass of the other components of the second shaft assembly 72, including the hub 140. By compliantly isolating the foregoing rotational mass structures, the elastic member 144 may introduce an additional degree of freedom that enables the timing wheel 102 to function as a tuned mass damper for the second shaft assembly 72. By compliantly isolating the first and second rotational mass structures, the elastic member 144 may induce relative rotational displacement (i.e., movement) between the timing ring 142 and the other components of the second shaft assembly 72, including the lobe members 92, 94, 96, 98. The relative rotational displacement may cause the timing ring 142 to oscillate rotationally out of phase with the second shaft 90.

The elastic member 144 may have a predetermined stiffness, or spring constant. For purposes of the present disclosure, spring constant will be used generally to refer to a mechanical property of the elastic member 144 that expresses the torque required to produce a unit of rotational displacement (e.g., degree) between the hub 140 and the timing ring 142. Structural, mechanical, and dimensional features of the elastic member 144 may be selected such that the elastic member 144 has the predetermined spring constant.

The spring constant may be selected such that the timing wheel 102 functions as a vibration absorber (i.e., tuned mass damper) and thereby lowers the torsional response of the second shaft assembly 72 within the predetermined frequency range. The spring constant may be further selected such that the relative rotational displacement between the timing ring 142 and the lobe members 92, 94, 96, 98 does not introduce an unsuitable amount of error in the measurement of the rotational position of the lobe members 92, 94, 96, 98.

In particular, the spring constant may provide a first torsional mode (i.e., natural frequency) for the timing wheel 102 alone that is equal to, or at least approximately equal to, a first torsional mode of the second shaft assembly 72 when evaluated as an N degree of freedom (DOF) vibration system in which the timing wheel 102 is treated as a single lumped mass (i.e., rigid body mass) rather than an N+1 DOF vibration system in which the timing wheel 102 includes a compliantly isolated mass. It should be understood that N is an integer greater than or equal to one that may correspond to, but is not limited to, the number of DOFs of interest within an operating speed range of the second shaft assembly 72 and/or an order content of the lobe members (e.g., lobes 92, 94, 96, 98) coupled for rotation with the second shaft 90. For clarity, the N DOF vibration system is referred to hereinafter as a baseline shaft assembly. When the first torsional mode of the timing wheel 102 is approximately equal to the first torsional mode of the baseline shaft assembly, the timing ring 142 and the second shaft 90 will vibrate at approximately equal frequencies and thereby cause the elastic member 144 to absorb vibration of the second shaft 90. As a non-limiting example, the first torsional mode of the timing wheel 102 may be within twenty percent of the baseline shaft assembly.

When constructed in the foregoing manner, the timing wheel 102 may provide two sideband natural frequencies for the second shaft assembly 72 that lower the amplitude of the torsional response. The spring constant may be varied to adjust the location of the first and second sideband frequencies and thereby adjust the amplitude of the torsional response to the torque input. In particular, the location of the first sideband frequency within the predetermined frequency range, and the location of the second sideband frequency above the predetermined frequency range may be adjusted. The spring constant may further vary to adjust the relative rotational displacement between the timing ring 142 and the lobe members 92, 94, 96, 98 in response to the torque input. In this manner, the timing wheel 102 may control the torsional response of the second shaft assembly 72, while not introducing an unsuitable amount of measurement error.

With particular reference to FIGS. 5-6, a non-limiting example of the elastic member 144 may include a plurality of spokes 152 that radially extend between the hub 140 and the timing ring 142. The spokes 152 may be generally flat, thin structures. The spokes 152 may be symmetrically disposed about the rotational axis 62 and may have center planes that, when projected, intersect the rotational axis 62. The spokes 152 may extend generally parallel to the rotational axis 62. The spokes 152 may be integrally formed with the hub 140 and the timing ring 142 as a single-piece (monolithic) part formed from the same base material. As a non-limiting example, the spokes 152 may be included in a single-piece part formed from steel.

Structural features of the spokes 152 may vary and may be selected such that, collectively, the spokes have the desired spring constant. The spokes 152 may each have a lateral thickness 154 viewed in the direction of the rotational axis 62 that may be substantially less than a longitudinal thickness 156 viewed along the rotational axis 62. By way of a non-limiting example, the lateral thickness 154 may be seventy-five percent less. The spokes 152 may each have a radial thickness 158 that may be substantially greater than the lateral thickness 154. By way of a non-limiting example, the radial thickness 158 may be seventy-five percent greater. The radial thickness 158 may be dictated by a physical space 160 between the hub 140 and the timing ring 142. The physical space 160 may dictate the radial thickness 158, as well as other features of the spokes 152, where it is desired that the first and second sets of teeth 148, 150 conform to existing specifications for sensing such teeth accurately and precisely.

The lateral thickness 154 among the spokes 152 may be approximately equal. The longitudinal thickness 156 among the spokes 152 may be approximately equal and the radial thickness 158 of each of the spokes 152 may also be approximately equal. The longitudinal thickness 156 may be less than a first width 162 of the hub 140 and a second width 164 of the annular ring 146.

FIG. 7 is a first chart illustrating an exemplary torque input in the frequency domain for the second shaft assembly 72 and is not intended to limit the present disclosure. More specifically, the first chart includes a Fast Fourier Transform (FFT) plot of camshaft torque versus frequency obtained by analysis that illustrates characteristic loads that may be transmitted to the second shaft assembly 72 by the intake valvetrain assembly 14. The FFT plot illustrates an exemplary torque input to the second shaft 90 when the second shaft assembly 72 is operated at a rotational speed of 3500 revolutions per minute (RPM). The rotational speed of 3500 RPM was chosen for the analysis to correspond to a maximum engine operating speed of 7000 RPM. In the plot of FIG. 7, camshaft torque in N-mm is plotted along the y-axis (labeled "Y1" in the chart) for various frequencies in Hz plotted along the x-axis (labeled "X1" in the chart).

The FFT plot illustrates that the energy content of the torque input at frequencies between 400 Hz and 1000 Hz is significant when compared to the torque input at frequencies below 400 Hz and above 1200 Hz. The significance can be seen by comparing the magnitude of the peak corresponding to a fundamental frequency that occurs at approximately 230 Hz and the magnitude of the peaks corresponding to second, third, and fourth harmonics that occur at frequencies equal to approximately 460 Hz, 690 Hz, and 920 Hz, respectively. For reference purposes, at 3500 RPM, the fundamental frequency of the torque input to the second shaft assembly 72 (and the second shaft 90), which has four lobe members 92, 94, 96, 98, is equal to approximately 233 Hz.

In view of the significant energy content at frequencies below 1000 Hz, it may be desired that the first and second shaft assemblies 70, 72 each have a first mode above 1000 Hz. As a non-limiting example, it may be desired that the first mode of the first and second shaft assemblies 70, 72 be above a predetermined target frequency of approximately 1100 Hz. The target frequency may establish the predetermined frequency range discussed above. Accordingly, for the above example, the predetermined frequency range includes frequencies between 0 Hz and 1100 Hz.

Alternatively, or additionally, the predetermined frequency range may be established by a predetermined order of rotation in the second shaft assembly 72. At 3500 RPM, the first order of rotation is equal to approximately 58.3 Hz. Typical valve lift profiles for camshaft lobes, such as the lobe members 80, 82, 84, 86, 92, 94, 96, 98 may generate components of torque input with significant energy content up to frequencies corresponding to between an $18^{th}$ and $20^{th}$ order. Accordingly, as a non-limiting example, it may be desired that the first mode of the first and second shaft assemblies 70, 72 be above a predetermined order of rotation in the second shaft assembly 72 between the $18^{th}$ and $20^{th}$ order for an in-line four cylinder engine. For comparison, it is noted that a predetermined target frequency equal to 1100 Hz, as discussed above, corresponds to about the $19^{th}$ order of rotation.

However, desired profiles (e.g., base circle profiles and/or lift profiles) for the lobe members 80, 82, 84, 86, 92, 94, 96, 98 and packaging constraints of the cylinder head structure 12 may dictate diameters of the second shaft 90 that result in the second shaft assembly 72 having a first torsional mode below the predetermined target frequency and/or target order of rotation when formed of conventional materials, such as steel. In such a case, the second shaft assembly 72 may exhibit resonant-type behavior within the operating speed range of the engine. Thus, the amplitude of the torsional response of the second shaft assembly 72 at frequencies near the first torsional mode may be unacceptably high, unless suitably controlled.

Table 1 below summarizes the torsional modes of a baseline timing wheel, the baseline shaft assembly, the timing wheel 102, and the second shaft assembly 72. The torsional modes of the baseline timing wheel and baseline shaft assembly are presented in row "B" of the table. The torsional modes of the timing wheel 102 and the second shaft assembly 72 are presented in the "D1" row of the table.

TABLE 1

| | Timing Wheel | Shaft Assembly | |
|---|---|---|---|
| Design | 1st Mode (Hz) | 1st Mode (Hz) | 2nd Mode (Hz) |
| B | 16110 | 904 | 2297 |
| D1 | 932 | 755 | 1365 |

The frequency values in the table were obtained by analysis. For the analysis, the baseline shaft assembly was equivalent to an N DOF system, while the second shaft assembly 72 was equivalent to an N+1 DOF system. In the analysis, the baseline shaft assembly is generally similar to the second shaft assembly 72, except that the baseline shaft assembly includes a baseline timing wheel instead of the timing wheel 102. The baseline timing wheel was equivalent to a single lumped mass having a rotational moment of inertia substantially equivalent to the rotational moment of inertia of the timing wheel 102.

As illustrated in the table, the baseline timing wheel alone has a first mode that may be well above the target frequency at 16110 Hz, while the baseline shaft assembly has a first mode that may be below the target frequency at 904 Hz and a second mode that may be well above the target frequency at 2297 Hz. Also illustrated in the chart, the timing wheel 102 alone may have a first mode at 932 Hz near the first mode of the baseline shaft assembly at 904 Hz, while the second shaft assembly 72 may have first and second modes at 755 Hz and 1365 Hz, respectively. While the second shaft assembly 72 may exhibit a first mode below both the target frequency and the first mode of the baseline shaft assembly, the amplitude of the response of the second shaft assembly 72 at frequencies near the first mode may be significantly reduced as discussed next.

Figure 8:
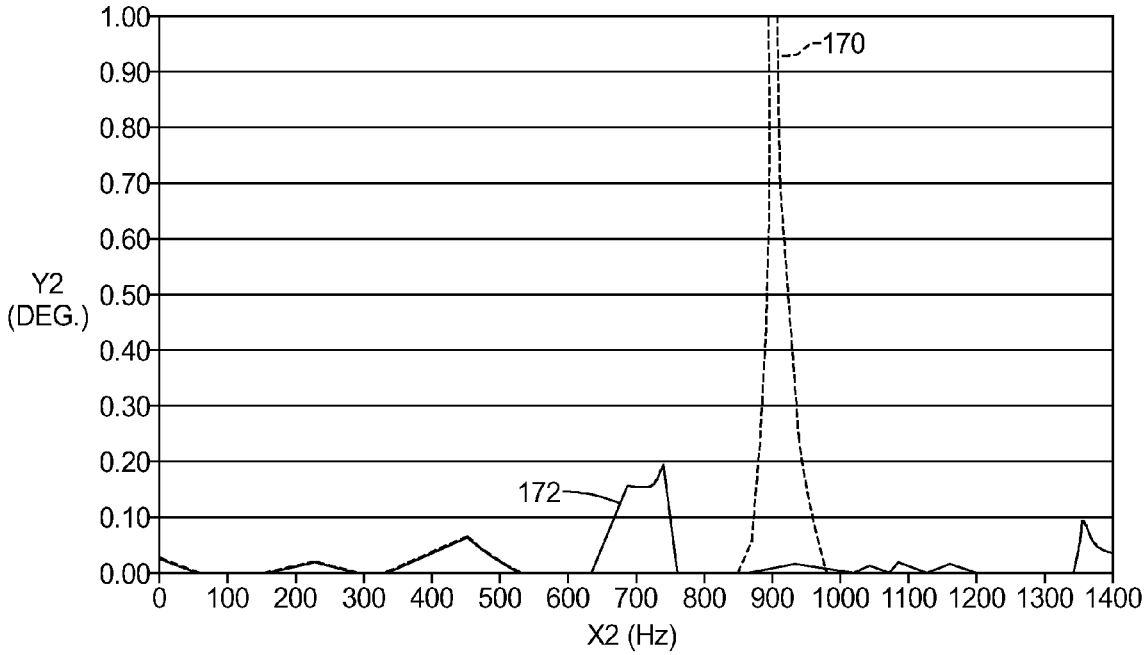
FIG. 8 is a chart illustrating a rotational response of the camshaft assembly of FIG. 1 to the torque input of FIG. 7.

FIG. 8 is a second chart including plots of the steady-state rotational responses of the baseline shaft assembly and the second shaft assembly 72 in the frequency domain and is not intended to limit the present disclosure. The second chart illustrates the rotational responses of the shaft assemblies to excitation by the torque input of FIG. 7. The rotational response plots were obtained by analysis and illustrate the rotational responses of the shaft assemblies at the location of the lobe member furthest from the driven end of the second shaft 90 (i.e., lobe member 98).

According to the analysis, this location represented the worst-case rotational response (i.e., worst-case amplitude) among the lobe members 92, 94, 96, 98. The analysis was performed with a frequency sweep from 0 to 1400 Hz using the torque input of FIG. 7 as a forcing function. In the second chart, the y-axis ("Y2" in the second chart) illustrates the rotational response in degrees of rotational displacement, while the x-axis ("X2" in the second chart) illustrates the frequency in Hz.

The rotational response for the baseline shaft assembly is designated by reference numeral 170, while the rotational response for the second shaft assembly 72 is designated by the reference numeral 172. As seen in the second chart, the baseline shaft assembly response 170 has a maximum amplitude at approximately 900 Hz. Although not shown in the second chart, the maximum amplitude as obtained in the analysis is approximately 2.5 degrees. On the other hand, the second shaft assembly 72 has a maximum amplitude that occurs at approximately 750 Hz and is significantly less at approximately 0.20 degrees.

It can be appreciated from the second chart that the timing wheel 102 may significantly reduce the maximum amplitude of the response of the second shaft assembly 72 when compared to shaft assemblies, such as the baseline shaft assembly, that include a conventional, rigid body timing wheel. The timing wheel 102 may reduce the response of a shaft assembly by compliantly isolating the mass of the timing ring 142 from the mass of the other components of the shaft assembly.

The spring constant of the elastic member 144 included with the timing wheel 102 may be selected such that the shaft assembly exhibits two sideband natural frequencies at which the amplitude of the torsional response is suitably low. In particular, the spring constant may be selected such that a first maximum relative rotational displacement between the lobe members 92, 94, 96, 98 does not exceed a predetermined value. The predetermined value may be selected such that a suitable level variation in seating velocity, valve timing, and/or cylinder-to-cylinder air distribution is achieved. The predetermined value may further be selected such that the torsional response does not exceed the fatigue capabilities of any one of the components of the second shaft assembly 72, such as the second shaft 90 and the timing wheel 102.

It has been observed through analysis that when the amplitude of the torsional response of the lobe members 92, 94, 96, 98 is suitably low, the amplitude of the relative rotational displacement between the timing ring 142 and any one of the lobe members 92, 94, 96, 98 may also be made suitably low. At a minimum, the amplitude of the relative rotational displacement may be controlled to inhibit the sensing of negative velocities of the second shaft assembly 72. Additionally, it has been observed that the spring constant may be selected such that a second maximum relative rotational displacement between the timing ring 142 and the lobe members 92, 94, 96, 98 does not exceed a predetermined error value.

What is claimed is:

1. A camshaft assembly comprising:

a first shaft adapted to be rotationally driven;

a first lobe member fixed for rotation with the first shaft; and a torsional damper fixed to the first shaft including a mass structure and an elastic member disposed between and coupling the mass structure and the first shaft, the elastic member having a spring constant providing a first sideband natural frequency and a second sideband natural frequency for the camshaft assembly.

2. The camshaft assembly of claim 1, wherein the torsional damper includes a tuned mass damper for the camshaft assembly that controls resonant behavior of the first shaft within an operating speed range of the first shaft.

3. The camshaft assembly of claim 1, wherein the first sideband natural frequency is less than a predetermined frequency based on a torque input to the first shaft within an operating speed range of the first shaft and the second sideband natural frequency is greater than the predetermined frequency.

4. The camshaft assembly of claim 3, wherein the first and second sideband natural frequencies are within the operating speed range of the first shaft.

5. The camshaft assembly of claim 1, wherein the mass structure includes a timing ring adapted to rotate relative to the first shaft during rotation of the first shaft.

6. The camshaft assembly of claim 1, wherein the mass structure includes an annular ring disposed radially outward of the first shaft and the elastic member includes a hub fixed to the first shaft and spokes extending radially from the hub to the annular ring.

7. The camshaft assembly of claim 6, wherein each of the spokes includes a planar member extending generally parallel to a rotational axis of the torsional damper and having a lateral thickness that is less than a corresponding longitudinal thickness and less than a corresponding radial thickness of the planar member.

8. The camshaft assembly of claim 7, wherein the hub, the annular ring, and the spokes are integrally formed as a monolithic member.

9. A camshaft assembly comprising:

a first shaft assembly including a first shaft and a first lobe member fixed to the first shaft, the first shaft adapted to be rotationally driven and defining an axially extending bore; and a second shaft assembly including a second shaft disposed within the axially extending bore and rotatable relative to the first shaft and including a first end adapted to be rotationally driven and a second end opposite the first end, a second lobe member rotationally supported on the first shaft and fixed for rotation with the second shaft, and a torsional damper fixed to the second shaft.

10. The camshaft assembly of claim 9, wherein the torsional damper is fixed to the second end of the second shaft and includes a timing ring adapted to rotate relative to the second shaft during rotation of the second shaft.

11. The camshaft assembly of claim 9, wherein the torsional damper includes a tuned mass damper for the second shaft assembly that controls resonant behavior of the second shaft in response to a torque input to the second shaft during rotation of the second shaft assembly.

12. The camshaft assembly of claim 9, wherein the torsional damper includes a hub fixed to the second shaft, an annular ring disposed radially outward of the hub, and an elastic member including spokes extending radially from the hub to the annular ring and coupling the hub to the annular ring.

13. The camshaft assembly of claim 12, wherein the spokes include planar members extending generally parallel to a rotational axis of the torsional damper, each of the spokes having a lateral thickness that is less than a corresponding longitudinal thickness and less than a corresponding radial thickness of the planar member.

14. The camshaft assembly of claim 12, wherein the hub, the annular ring, and the elastic member are integrally formed as a monolithic member.

15. A camshaft assembly comprising:

a first shaft assembly including a first shaft and a first lobe member fixed to the first shaft, the first shaft adapted to be rotationally driven and defining an axially extending bore; and a second shaft assembly including a second shaft disposed within the axially extending bore and rotatable relative to the first shaft and including a first end adapted to be rotationally driven and a second end opposite the first end, a second lobe member rotationally supported on the first shaft and fixed for rotation with the second shaft, and a torsional damper fixed to the second shaft including an annular ring and an elastic member disposed between and coupling the annular ring to the second shaft, the elastic member adapted to provide a first rotational oscillation of the annular ring that is out of phase with a corresponding second rotational oscillation of the second shaft during rotation of the second shaft.

16. The camshaft assembly of claim 15, wherein the torsional damper includes a tuned mass damper for the second shaft assembly that controls resonant behavior of the second shaft within an operating speed range of the second shaft.

17. The camshaft assembly of claim 16, wherein the elastic member has a spring constant providing a natural frequency for the torsional damper within twenty percent of a natural frequency of the second shaft assembly when the torsional damper is considered a rigid body.

18. The camshaft assembly of claim 15, wherein the torsional damper is fixed to the second end of the second shaft and the annular ring includes a timing ring adapted to rotate relative to the second shaft during rotation of the second shaft.

19. The camshaft assembly of claim 15, wherein the torsional damper includes a hub fixed to the second shaft, the annular ring is disposed radially outward of the second shaft and the elastic member includes spokes extending radially from the hub to the annular ring.

20. The camshaft assembly of claim 19, wherein each of the spokes includes a planar member extending generally parallel to a rotational axis of the torsional damper and having a lateral thickness that is less than a corresponding longitudinal thickness and less than a corresponding radial thickness of the planar member.

* * * * *